US005171616A

United States Patent [19]

Dejima

[11] Patent Number: 5,171,616

[45] Date of Patent: Dec. 15, 1992

[54] STRUCTURAL-MEMBER FOR MUSICAL INSTRUMENT AND METHOD OF MANUFACTURING THE SAME

[75] Inventor: Tatsuya Dejima, Hamura, Japan

[73] Assignee: Casio Computer Co., Ltd., Tokyo, Japan

[21] Appl. No.: 486,236

[22] Filed: Feb. 28, 1990

[30] Foreign Application Priority Data

Mar. 13, 1989 [JP] Japan ..... 1-60412

[51] Int. Cl.[5] ..... G10D 3/02; G10H 3/18

[52] U.S. Cl. ..... 428/22; 428/137; 428/138; 428/537.1; 84/291; 84/293

[58] Field of Search ..... 84/291, 293; 428/17, 428/22, 537.1, 137, 138

[56] References Cited

U.S. PATENT DOCUMENTS

| | | | |
|---|---|---|---|
| 2,329,366 | 9/1943 | Weill et al. | 428/138 |
| 2,488,555 | 11/1949 | Paré et al. | 428/138 |
| 2,694,025 | 11/1954 | Slayter et al. | 428/138 |
| 3,286,784 | 11/1966 | Mariner | 428/138 |
| 3,427,915 | 2/1969 | Mooney | 84/291 |
| 3,440,919 | 4/1969 | Baker | 84/291 |
| 3,444,956 | 5/1969 | Gaffney | 428/138 |
| 3,551,270 | 12/1970 | Sharkey | 428/138 |
| 3,618,442 | 11/1971 | Kawakami | 84/291 |
| 3,664,911 | 5/1972 | Takabayashi | 84/291 |
| 3,699,836 | 10/1972 | Glasser | 84/291 |
| 3,724,312 | 4/1973 | Yamada et al. | 84/193 |
| 3,880,040 | 4/1975 | Kaman | 84/291 |
| 3,974,730 | 8/1976 | Adams | 84/291 |
| 4,042,745 | 8/1977 | Cornwell et al. | 428/138 |
| 4,145,948 | 3/1979 | Turner | 84/293 |
| 4,192,213 | 3/1980 | Steinberger | 84/293 |
| 4,232,067 | 11/1980 | Coleman | 428/17 |
| 4,334,452 | 6/1982 | Morrison | 84/291 |
| 4,631,218 | 12/1986 | Olofsson | 428/137 |
| 4,951,542 | 8/1990 | Chen | 84/293 |
| 4,973,507 | 11/1990 | Horian | 428/137 |

*Primary Examiner*—Ellis P. Robinson
*Assistant Examiner*—Archene Turner
*Attorney, Agent, or Firm*—Frishauf, Holtz, Goodman & Woodward

[57] ABSTRACT

A structural member used for the manufacture of a musical instrument such as a plucked string musical instrument, arco string musical instrument or keyboard musical instrument, comprises a structural-member body, which is formed by kneading a mixture including a large number of cut pieces of natural plant and a binder, and compressing the kneaded mixture under heat to form the structural-member body. A decorative plate is fixed to at least a part of the outer surface of the structural-member body.

6 Claims, 4 Drawing Sheets

STRUCTURAL-MEMBER FOR MUSICAL INSTRUMENT AND METHOD OF MANUFACTURING THE SAME

BACKGROUND OF THE INVENTION

1. Field of the Invention

The present invention relates to structural-members of musical instruments such as a plucked string musical instrument, an arco string musical instrument and a keyboard musical instrument and to a method of manufacturing such structural members.

2. Description of the Related Art

It was customary to use a plate of precious wood such as maple, beech wood or mahogany for forming the body of any of various stringed musical instruments and acoustic pianos. The body formed of a plate of precious wood exemplified above exhibits satisfactory musical properties and a high mechanical strength. In addition, a plate of the precious wood is suitable to be used as a sound board because it highly resonates with vibration of the strings. However, it is laborious to work the precious wood into a desired shape. In the manufacture of, for example, an electric guitar, a body member having a predetermined planar shape is prepared first, followed by imparting a complex curved shape to the side surface of the body member. Further, the upper surface of the body member must be provided with a recess for coupling with a neck, an opening for mounting a bridge base and another opening for mounting electronic parts.

What should also be noted is that natural wood comprises soft portions and hard portions (growth ring portions). Naturally, the soft portion tends to shrink greatly over a relatively long period of time, compared with the hard portion, with the result that a smooth surface of the body portion, if formed of a single piece of wood, tends to be roughened with time. Where a decorative plate is bonded to the smooth surface of the body portion, the decorative plate is also deformed by the deformation of the smooth surface of the body portion. Thus, the appearance of the body portion is impaired. Where the surface of the body portion is further roughened so that the depth of the dent becomes larger, the decorative plate tends to be peeled from the body portion or tends to be cracked. The cracking of the decorative plate is caused by a large difference in a coefficient of shrinkage between the material of the body portion and the material of the decorative plate. Further, the openings, formed in the body portion, for mounting electronic parts, etc. are deformed with time so that the size of the opening is changed with time.

An idea of using a fiber-reinforced resin or a special synthetic resin for forming the body portion of a musical instrument is disclosed in, for example, U.S. Pat. Nos. 3,880,040; 4,192,213; 3,427,915; 3,618,442; and 3,664,911. The use of such a resin is certainly effective for overcoming the above-noted problems inherent in the use of a single piece of wood for forming the body portion of a musical instrument, but is highly expensive.

SUMMARY OF THE INVENTION

This invention is contrived from the above described various conventional problems.

A first object of the present invention is to provide a structural member for musical instruments, which is fully comparable in acoustic properties with a single piece of wood such as maple, beech wood or mahogany, and is low in cost.

A second object is to provide a method of manufacturing a structural member for musical instruments, which permits easy and rapid manufacturing of a structural member for musical instruments at a markedly low cost.

According to the present invention, there is provided a structural member for musical instruments, comprising: a structural-member body formed by kneading a mixture including a large number of cut pieces of natural plant and a binder; and a decorative plate fixed to at least a part of the outer surface of the structural-member body.

The term "natural plant" noted above denotes a concept which includes, for example, precious wood widely used for forming the conventional stringed musical instrument such as maple, beech wood and mahogany; and ordinary wood widely available at a relatively low cost such as pine, cedar, ginkgo, chestnut tree, and zelkova. In addition, bamboo is also included in the concept of "natural plant" used herein. The term "cut pieces" noted above denotes a concept which includes chips, small lumps, slices, powders, and grains prepared from the natural plant. The term "binder" denotes a concept which includes a synthetic resin and an adhesive, which serve to achieve a strong bonding of the cut pieces, an additive serving to improve the acoustic properties of the musical instrument, and a small amount of filler. Further, the term "decorative plate" used herein denotes a concept which includes, for example, a natural wood board prepared from a precious wood such as maple, beech wood and mahogany; plywood formed of natural wood; and a synthetic resin plate. A decorative layer may be formed on the surface of such a board or plate as noted above in the present invention.

The present invention also provides a method of manufacturing a structural member for musical instruments, comprising a first step of kneading a mixture including a large number of cut pieces of natural plant and a binder; a second step of filling the mixture kneaded in the first step in a mold, followed by compressing the filled mixture under heat to form a structural-member body from the filled mixture; and a third step of fixing a decorative plate to the surface of at least a part of the structural-member body.

Further, the present invention also provides a method of manufacturing a structural member for musical instruments, comprising a first step of kneading a mixture including a large number of cut pieces of natural plant and a binder; and a second step of filling the mixture kneaded in the first step in a mold, followed by compressing the filled mixture under heat to form the structural member from the filled mixture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Various embodiments of this invention will now be explained in detail below with reference to the accompanying drawings.

Figure 1:
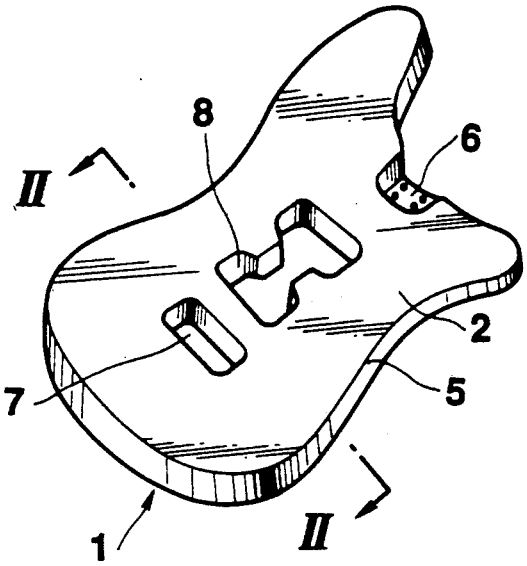
FIG. 1 is an oblique view showing the body of an electric guitar constructed by a structural member for musical instruments of the present invention.
Figure 2:
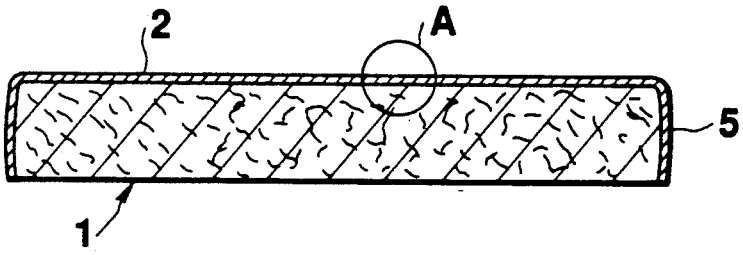
FIG. 2 is a cross sectional view along the line II—II shown in FIG. 1.

FIGS. 1 and 2 are an oblique view showing the body 1 of an electric guitar constructed by a structural member for musical instruments of the present invention, and the cross sectional view along the line II—II in FIG. 1.

Figure 3:
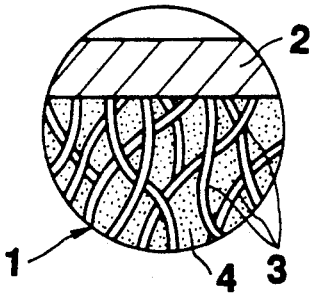
FIG. 3 is an enlarged view of a part A in FIG. 2.

As seen from FIG. 3, the body 1 is formed of a material prepared by kneading a mixture including a large number of stalk chips 3 of arbor serving to construct a large member of pieces of a natural plant, and binder 4 serving to bond the stalk chips 3 to each other and to make the structure harder so as to have a predetermined mechanical strength.

Figure 4A:
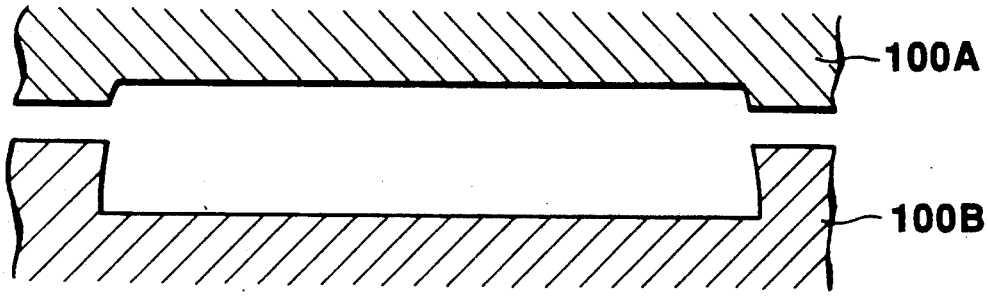
FIGS. 4A and 4B are cross sectional views showing an example of a method of manufacturing a structural member for musical instruments of the present invention.
Figure 4B:
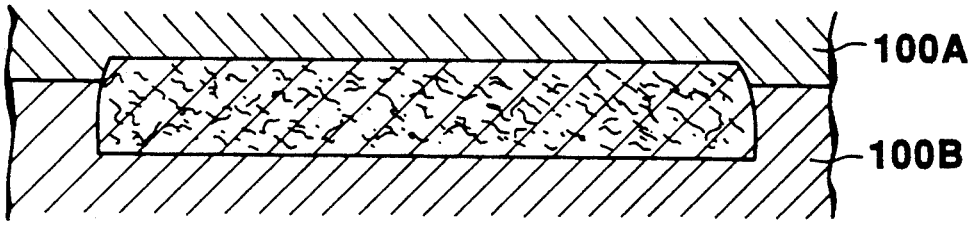

For manufacturing the body 1, a mixture including stalk chips 3 and binder 4 is kneaded so that the stalk chips 3 are mixed in the binder 4 to have a predetermined density. Then, the mixture is filled in a mold 100A and 100B for forming a body, shown in FIG. 4A, and the filled mixture is compressed under heat at a predetermined condition, as shown in FIG. 4B. As a result, the body 1 having a predetermined shape is easily obtained. In the above described process, the body 1 having an outline portion 5 of a complex curved shape, a recess 6 for coupling with a neck member, an opening 7 for mounting a bridge base, and another opening 8 for mounting electronic parts, etc., as shown in FIG. 1 is formed at one time, without cutting or the like working for forming the outline portion 5, the recess 6, the openings 7, 8, etc.

The body 1 formed by the above described process is a wooden body but is uniform in cellulose density unlike the conventional body formed of a single piece of wood which has soft portions and hard portions (growth ring portions). Naturally, the body 1 is unlikely to be shrunk or strained with time and keeps its smooth surface over a long period of time. It should be noted that the stalk chips 3 are buried in the binder 4 in the compression step under heat, with the result that a hardened binder 4 having a predetermined mechanical strength is exposed on the surface of the body 1. After formation of the body 1, the smooth upper and rounded side surfaces of the body 1 are coated with a polyester type paint to form the coating film 2.

In the embodiment described above, cellulose fibers prepared by decomposing a trunk of cheap arbor such as pine, cedar, ginkgo tree or bamboo into a fibrous state are used for forming the stalk chips 3. Alternatively, the stalk chips 3 may be provided by, for example, stalk chips of precious wood such as maple, beech wood or mahogany. Small lumps or slices of the above described various materials may be used as the stalk chips 3.

The binder 4 used in the embodiment described above is a thermoplastic resin such as an epoxy resin or urea resin, etc. Alternatively, a thermosetting resin may be used as the binder 4. The binder 4 fixes stalk chips 3 to each other and hardens to have a predetermined mechanical strength. It is possible for the binder 4 to contain various additives effective for improving the acoustic properties of the musical instrument.

The body 1 formed as described above is fully comparable in acoustic effects with the conventional body formed by cutting a precious wood such as maple, beech wood or mahogany. Even if the stalk chips 3 are of, for example, pine, cedar, ginkgo tree or bamboo, the body 1 exhibits a fine outer appearance because the stalk chips 3 are buried in the binder 4. Further, the body 1 is not formed of a single wood plate but is formed of a large member of stalk chips 3 of wood and the binder 4, so that the material cost is cheap. Of course, any part of a wood material can be used in the present invention, leading to further cost saving, unlike the conventional body formed by cutting a part of a wood material.

The above described embodiment shows the body of an electric guitar. The construction of the body can also be employed for the sound board of an acoustic guitar. In this case, it is not absolutely necessary for the binder 4 to be hardened completely.

Figure 5:
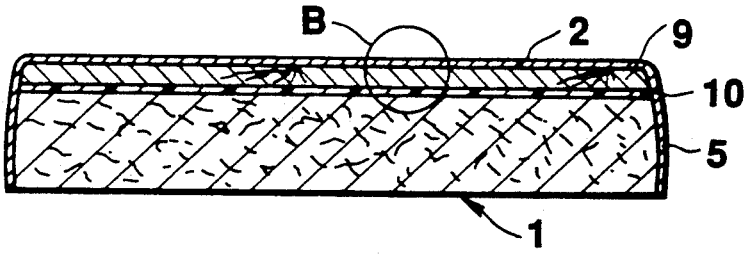
FIG. 5 is a cross sectional view showing another embodiment of the present invention.
Figure 6:
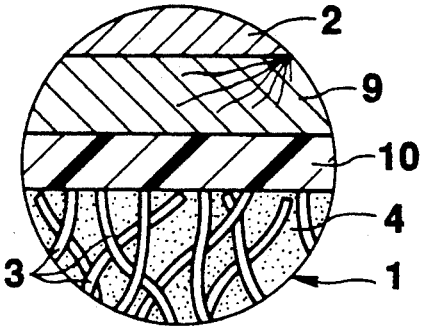
FIG. 6 is an enlarged view of a part B in FIG. 5.

FIGS. 5 and 6 show the body 1 on the entire upper surface of which a decorative plate 9 is fixed with an adhesive 10. In this case, the coating film 2 is formed on the upper surface of the decorative plate 9. The decorative plate 9 is formed of a precious wood such as mahogany or maple, or a fiber-reinforced resin. As shown in FIG. 6, the decorative plate 9 is fixed on the upper surface of the body 1 with the adhesive 10 of a cyano acrylate series adhesive containing vinyl chloride series emulsion, urea resin, ammonium chloride solution and flour (a fixing agent). Alternatively, an epoxy series or organic solvent series adhesive may be used, depending on the material of the decorative plate 9.

Figure 7:
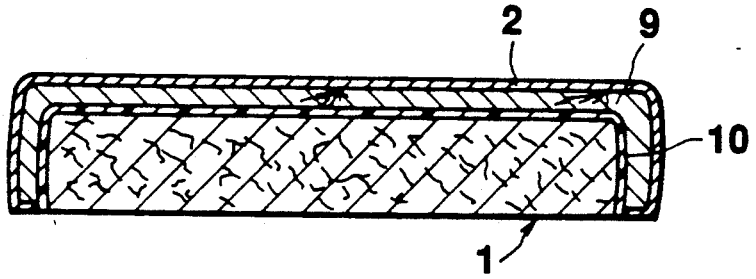
FIG. 7 is a cross sectional view showing another embodiment of the body of an electronic guitar.
Figure 8:
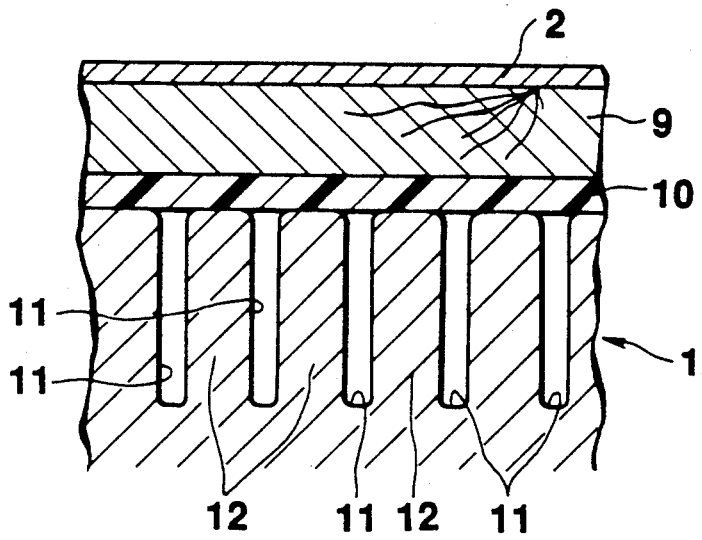
FIG. 8 is a cross sectional view showing in a magnified fashion a part of still another embodiment of the body of an electronic guitar.

As described previously, the surface of the body 1 is not roughened over a long period of time, so that the decorative plate 9 disposed on the smooth surface of the body 1 is not roughened over a long period of time and plate 9 is not cracked. Therefore, it is possible to make the thickness of the decorative plate 9 as thin as posible to, for example, 0.5 mm or less. Such a remarkably thinned decorative plate 9 is very flexible, with the result that the decorative plate is more unlikely to be cracked. Further, the remarkably thinned decorative plate 9 can be bent to cover the side surface of the body 1, as shown in FIG. 7.

Where the decorative plate 9 is bonded to the upper surface of the body 1, it is desirable to form a plurality of bottomed slits 11 in the upper surface of the body 1 such that the slits extend substantially along the wood grains of the decorative plate 9, as shown in FIG. 8. Wish this construction, even if the decorative plate 9 is shrunk, the shrinkage is facilitated by the slits 11. In other words, the resistance of the body 1 to the shrinkage is moderated by the slits 11, with the result that the decorative plate 9 is unlikely to be cracked in spite of its shrinkage. To be more specific, the shrinkage of the decorative plate 9 causes that portion of the body 1 which is interposed between the adjacent slits 11 to be deformed so as to absorb the shrinkage. It follows that a big resistance is not given by the body 1 to the shrinkage of the decorative plate 9. Incidentally, a plurality of slits 11 are shown in the drawing. However, it suffices to form at least one slit in the upper surface region of the body 1.

Figure 9:
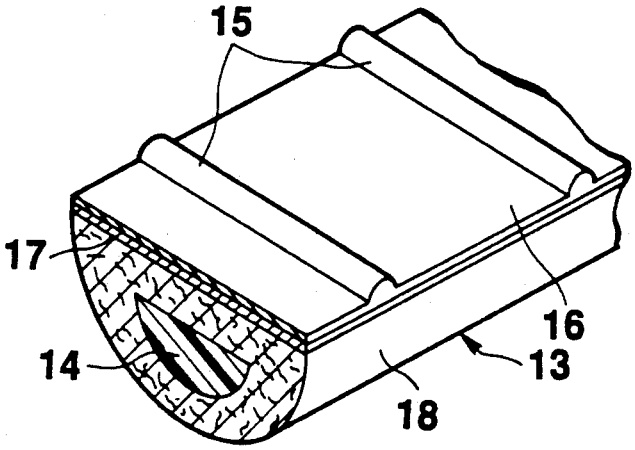
FIG. 9 is an oblique view showing a part of the neck of an electric guitar formed of a structural member of the present invention.

FIG. 9 shows a neck member 13 coupled with the body 1 of the electric guitar shown in FIG. 1. The neck member 13 is formed by filling a material, similar to that used for forming the body 1, in a mold (not shown) for forming a neck member, and compression molding under heat. As seen from the drawing, an aggregate 14 is embedded in the axial region of the neck member 13 so as to prevent the neck member 13 from being warped or twisted by, for example, the tension of the strings of the guitar. The aggregate 14 is formed of fiber-reinforced resins, e.g., epoxy resin, polyester resin or polyimide resin reinforced by carbon fiber, aramide fiber or glass fiber. Further, a fingerboard 16 having a number of frets 15 integrally formed thereon is fixed to the upper surface of the neck member 13, with an adhesive 17, which is the same as the adhesive 10.

In this neck 13, an outline portion 18 surrounding the aggregate 14 to have a half moon shaped cross section can be easily formed by the same process as that for forming the body 1 with the same material as that of the body 1. Thus, the outline portion 18 of the same material as that of the body 1 is not roughened or deformed at its upper surface, and the smoothness of the upper surface is maintained over a long period of time. Therefore the finger board 16 will not crack. And the material cost of the neck member 13, the material of which mainly comprises a large member of stalk chips and a binder, is cheap.

Figure 10:
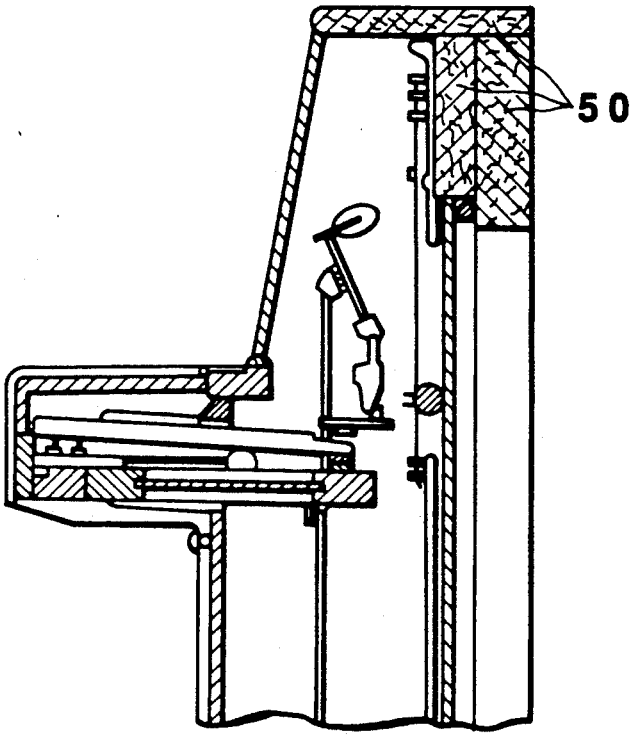
FIG. 10 is a sectional view showing a part of a piano to which a structural member of the present invention is applied.

In the embodiments described above, the technical idea of the present invention is employed for the the body and neck member of an electric guitar. In addition, the present invention can be applied to the body and neck member of other plucked string musical instruments and arco string musical instruments such as a violin as well as to the manufacture of a housing 50 of a keyboard musical instrument such as a piano, as shown in FIG. 10.

Figure 11:
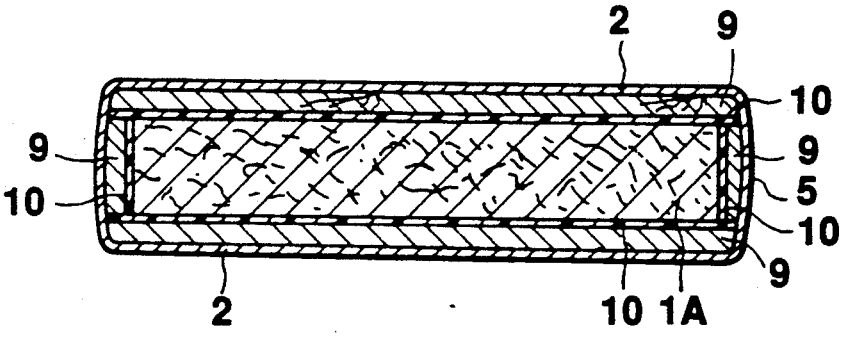
FIG. 11 is a cross sectional view showing the body of still another embodiment of an electronic guitar of the present invention.

In the embodiment shown in FIG. 7, the decorative plate 9 is fixed to the upper and side surfaces of the body 1 with the adhesive 10. However, it is also possible to fix the decorative plate 9 to the entire outer surface of a structural member 1A for musical instruments, with the adhesive 10, as shown in FIG. 11.

Further, in the structural member for musical instruments of the invention, the stalk chips may be selected from various kinds of natural plants on the basis of a sympathetic-resonance performance and a stiffness, etc. which are needed for the structural member.

And, the shape of the stalk chips may be suitably selected from a small lump, a slice, a fiber, powder, and grains.

An adhesive or the like can also be used as the binder in the present invention.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A structural-member for musical instruments, comprising:

a structural-member body formed by kneading a mixture including a large number of cut pieces of natural plant and a binder to produce a kneaded mixture, and forming the kneaded mixture to a desired shape of the structural-member body;

a single natural wood plate fixed directly to at least a part of an outer surface of the structural-member body; and a plurality of bottomed slits formed in substantially the area of the outer surface region of the structural-member body to which the single natural wood plate is directly fixed, to permit shrinkage of the single natural wood plate relative to the structural-member body without cracking thereof.

2. The structural-member of claim 1, wherein the kneaded mixture is molded to said desired shape.

3. The structural-member of claim 1, wherein the natural plant is natural wood.

4. The structural-member of claim 2, wherein the binder comprises a synthetic resin.

5. The structural-member of claim 2, the binder comprises an adhesive.

6. The structural-member of claim 2, wherein the binder comprises a thermoplastic synthetic resin.

* * * * *